US008955726B1

(12) United States Patent
Thielman et al.

(10) Patent No.: US 8,955,726 B1
(45) Date of Patent: Feb. 17, 2015

(54) SELF-DEFENSE ORNAMENTAL BRACELET

(71) Applicants: Deborah-Susanne Sayon Thielman, Fredericksburg, VA (US); Gerhard Willms Thielman, Fredericksburg, VA (US)

(72) Inventors: Deborah-Susanne Sayon Thielman, Fredericksburg, VA (US); Gerhard Willms Thielman, Fredericksburg, VA (US)

( * ) Notice: Subject to any disclaimer, the term of this patent is extended or adjusted under 35 U.S.C. 154(b) by 77 days.

(21) Appl. No.: 13/763,734

(22) Filed: Feb. 11, 2013

(51) Int. Cl.
*A45F 5/00* (2006.01)
*B26B 29/02* (2006.01)
*F41B 13/04* (2006.01)

(52) U.S. Cl.
CPC ..... *A45F 5/00* (2013.01)
USPC ..... 224/232; 224/222; 224/267; 30/143

(58) Field of Classification Search
USPC ..... 224/222, 232–233, 251, 267, 916; 30/142–143, 151; D3/220
See application file for complete search history.

(56) References Cited

U.S. PATENT DOCUMENTS

| | | | | | |
|---|---|---|---|---|---|
| 967,320 | A * | 8/1910 | Brooks | 224/249 |
| 5,031,810 | A * | 7/1991 | Finn et al. | 224/581 |
| 5,058,788 | A * | 10/1991 | Newmark | 224/222 |
| 5,211,322 | A * | 5/1993 | Nealy | 224/232 |
| 5,647,130 | A * | 7/1997 | Collins | 30/151 |
| 5,755,366 | A * | 5/1998 | Mazzo | 224/222 |
| 7,766,203 | B2 * | 8/2010 | Marinaj | 224/661 |
| 7,818,885 | B2 * | 10/2010 | Lafauci et al. | 30/294 |
| 2006/0112565 | A1 * | 6/2006 | Moser | 30/151 |
| 2007/0170216 | A1 * | 7/2007 | Davis | 224/222 |

* cited by examiner

*Primary Examiner* — Justin Larson
*Assistant Examiner* — Scott McNurlen

(57) ABSTRACT

An arm bracelet is provided for containing a retrievable blade around a forearm between wrist and elbow. The bracelet includes first and second bands, a network, bridges and a housing. The bands wrap around and attach to the forearm. The first band is disposed adjacent the wrist. The second band is disposed adjacent the elbow. The network connects the first and second bands together along the forearm. The bridges detachably extend from the first and second band. Each bridge includes a plurality of shapes. Each shape is able to form a grip. The housing for contains a sheath that holds a knife with a handle and the blade. The handle superficially resembles the shape to aid concealment of the knife.

18 Claims, 4 Drawing Sheets

SELF-DEFENSE ORNAMENTAL BRACELET

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to ornamental bracelets that include self-defense attachments. In particular, this invention relates to arm bracelets that incorporate concealed daggers for defending against attackers.

In an effort to manage criminal activity, municipal administrators of metropolitan areas often impose restrictions on civilians that reside and/or labor in such crowded urban environments. Such regulations can include firearms (e.g., pistols), chemical aerosols (e.g., pepper-spray), and electroshock discharge instruments (e.g., stun-guns) in an effort (frequently vain) to curtail human violence. In addition, such devices can be clumsy to carry and/or conceal, and may require maintenance or non-intuitive instruction to operate successfully for disabling or warding off an attacker.

SUMMARY

Conventional self-defense devices yield disadvantages addressed by various exemplary embodiments of the present invention. In particular, exemplary embodiments provide an arm bracelet for containing a retrievable blade around a forearm between wrist and elbow. The bracelet includes first and second bands, a network, bridges and a housing. The bands wrap around and attach to the forearm. The first band is disposed adjacent the wrist. The second band is disposed adjacent the elbow. The network connects the first and second bands together along the forearm.

The bridges detachably extend from the first and second band. Each bridge includes a plurality of shapes. Each shape is able to form a grip. The housing contains a sheath that holds a knife with a handle and the blade. The handle superficially resembles the shape to aid concealment of the knife. Various exemplary embodiments provide uniform shapes that have a regular profile with alternating orientations.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
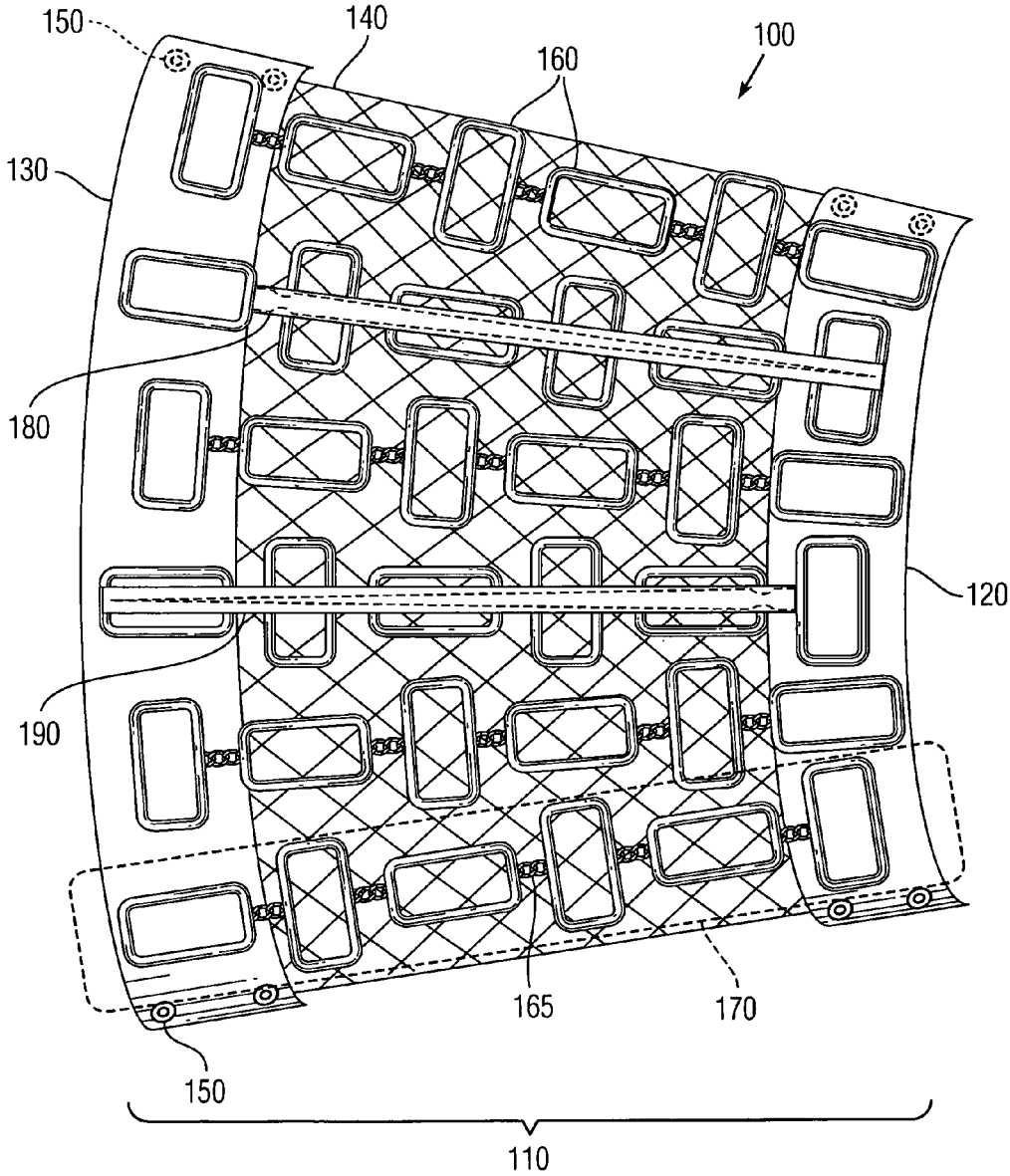
FIG. 1 is a plan view of an exemplary bracelet laid out unworn, including sheathed daggers.

FIG. 1 shows a plan view 100 of an exemplary bracelet 110 with sheathed daggers or similar knives. The bracelet 110 includes a wrist-band 120 and an elbow-band 130 joined by cords 140 that diagonally extend across the arm length separating the bands. The bands 120 and 130 can be connected together at their ends by button snaps 150, with those shown in solid outline being on and above the outer visible surface of the bands 120 and 130, and those in dash outline being underneath and thereby hidden from plain view.

An exemplary dimension for arm length distance can be provided as about eight inches (8") for purposes of description. The thickness of the arm of a typical wearer of the exemplary bracelet varies based on physical build and other physiological factors. The arc length of the wrist-band 120 can be described as extending between five inches and seven inches (5"-7"). Similarly the arc length of the elbow-band 130 can be estimated as between six and ten inches (6"-10").

The bands 120 and 130 can be formed from a thick flexible material, such as leather or vinyl. The cords 140 can be elastic or non-elastic string-type material, or else can constitute a web such as fishnet fabric or decorative cloth. The cords 140 can be attached to the bands 120 and 130 either by detachable fasteners, such as snap buttons or permanently affixed thereto. The button snaps 150 for connecting together the ends of the bands 120 and 130 can be metal or rigid plastic, and multiple sets of these can be arranged for sundry extents of overlap, depending on arm thickness.

A plurality of regular (i.e., uniform pattern) shapes 160 extend from the wrist-band 120 to the elbow-band 130. The shapes 160, which are depicted as rounded rectangles, connect to each other by chain links 165. The shapes 160 can comprise carbon fiber composite or a rigid plastic. The rectangles are arranged in the displayed embodiment as alternating width and length along the distance between the bands 120 and 130. These alternations relate to longitudinal and transverse directions relative to the forearm. The chains 165 can incorporate twist-link configuration to reduce overall thickness, and can be composed of metal or rigid plastic.

A set of these shapes 160 extending along the arm represent a bridge 170. The shapes 160 at the extremities of the bridge 170 can include mechanisms for removable attachment to their respective bands 120 and 130, such as Velcro strips (not shown), with appropriate counterpart strips on those bands secured by adhesive (e.g., glue) to their respective surfaces.

Alternative mechanisms for such attachment between the shapes 160 and their bands can be contemplated without departing from the scope of the claims, such as button snaps, latches, and other techniques. Some of the bridges 170 can be substituted by first and second braces 180 and 190, in which one of the shapes 160 at the extremities remains unconnected by chain 165 to the remainder, but rather represents a grip or handle. The braces preferably include a pike or dagger or alternative thrust edge, as described subsequently in greater particularity.

Figure 2:
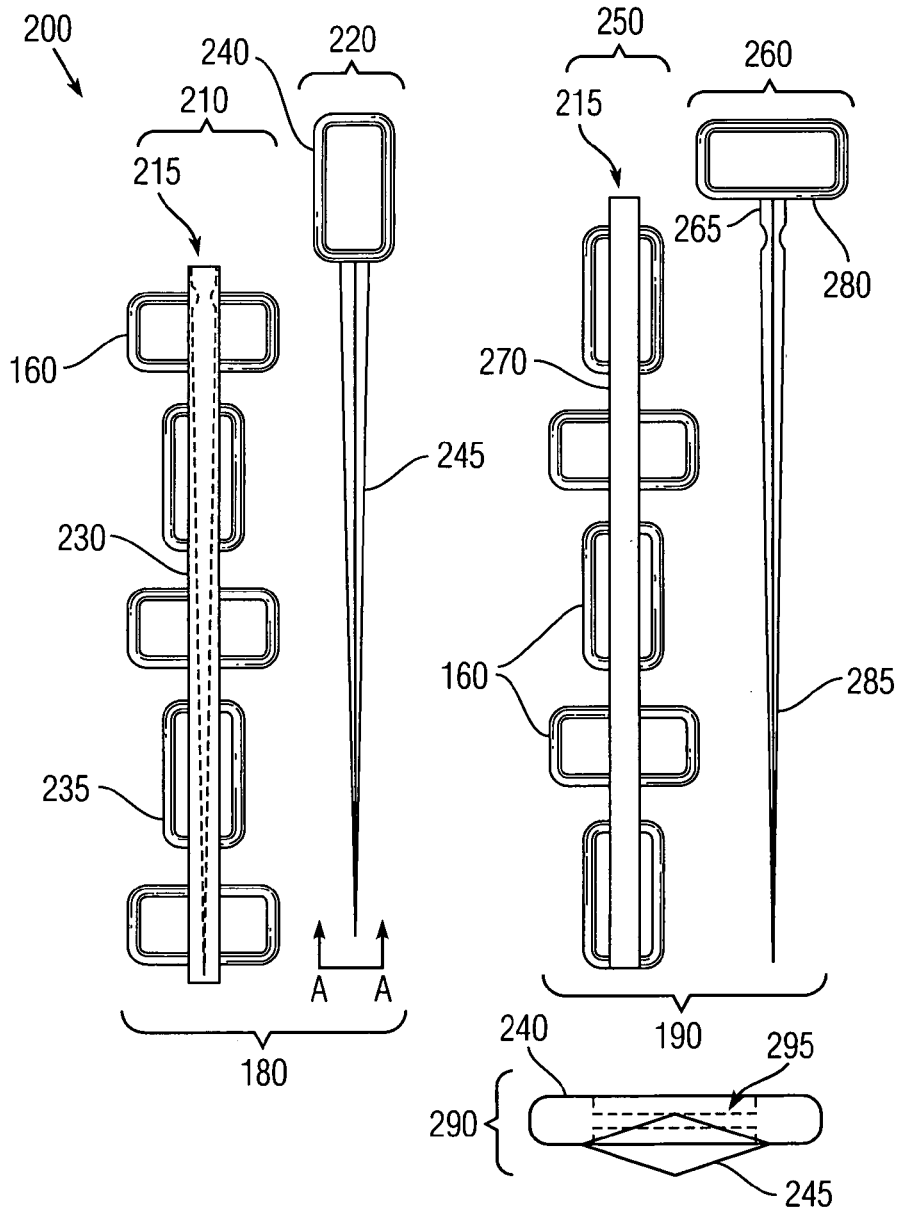
FIG. 2 is a plan view of the sheathed daggers along with a detail elevation view.

FIG. 2 shows a plan view 200 of the sheathed daggers. The first brace 180 constitutes a housing 210 with an opening 215 and an elbow drawn dagger 220. The housing 210 includes a scabbard 230 that mounts to a concatenation of shapes 160 terminating at the elbow end with the opening 215. The dagger 220 includes a handle 240 that closely resembles one of the shapes 160 and a blade 245, which can be inserted into the scabbard 230 through the opening 215. The scabbard 230 can have interior walls 235 that conform to the contours of the blade 245 to ensure a tighter fit for reduced jostling and greater uniformity of material density of the scabbard 230 and blade 245 together.

The second brace 190 constitutes a housing 250 with an opening 255 and a wrist drawn pike 260 having a narrowed hilt 265. The housing 250 includes a scabbard 270 that mounts to a concatenation of shapes 160 terminating at the wrist end with the opening 255. The dagger 260 includes a handle 280 that closely resembles one of the shapes 160 and a blade 285, which can be inserted into the scabbard 270 through the opening 255. The scabbard 270 can have an interior cavity contoured to conform to the blade 285. The hilt 265 incorporates a relatively smooth (i.e., unsharpened) perimeter to enable being held between the middle and ring fingers at the knuckles.

A detail elevation view 290 reveals an A-A section of the dirk 220 with the handle 240 and the blade 245 with wedge contour and having a double-edge rhombus cross-section having quadrilateral symmetry for this example. Artisans of ordinary skill will recognize that the blades 245 and 285 can taper in linear form or alternate shape, such as ogive, depending on preference. (An ogive shape resembles a truncated parabola.) Moreover, the cross-section can constitute a variety of forms. Knife blades can assume commonly available forms such as pen knife, salmon knife, punch blade and clip point blade.

The handles 240 and 280, as well as the shapes 160, can include indentations 295 to reduce weight and/or provide decorative distraction. As shown, the handles 240 and 280 can constitute the same general contour as the shapes 160 with alternating orientations, such as on the bridges 170.

Alternatively, the indentations 295 can penetrate through the handle 240 and 280 to render the interior hollow inside the outer perimeter or outline of the handle 240 and 280. Either of these visual and geometric configurations can be similarly extended to the shapes 160 for greater symmetry and uniformity of the bridges 170 to the handles 240 and 280. The shapes 160 can have alternating aspect ratios between the longitudinal and transverse directions.

The sheaths 230, 270 handles 240, 280 and blades 245, 285 can be composed of carbon fiber composite or rigid plastic (e.g., acetals, amino resins, phenolics, polyamids) to reduce detection by registering instruments for reflected magnetic pulse. Carbon fiber has a density of 1.76 g/cm$^3$. Assuming a brace of about seven inches (7") in length and a scabbard of about one-half inch (½') in width and of three-eighths inch (⅜") in thickness, such an instrument could be expected to have a mass of 35 grams to 40 grams (roughly 1 oz-1.5 oz). Alternatively, the blade can comprise a comparatively rigid metal, such as steel, assuming detection by dynamic electromagnetic fields is not of concern.

Figure 3:
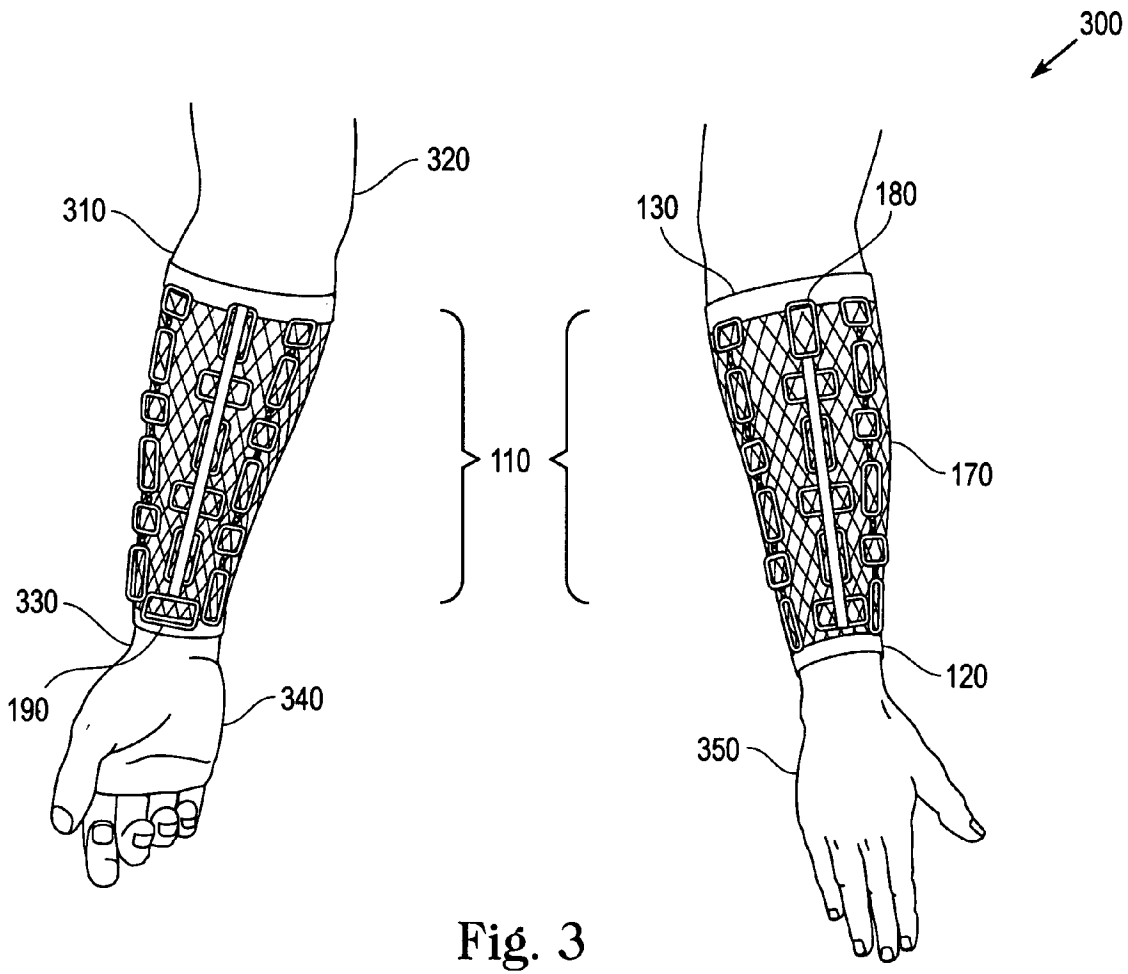
FIG. 3 is a perspective view of the arm bracelet with the decoratively concealed weapons.

FIG. 3 shows perspective views 300 of a right forearm 310 wearing the bracelet 110 decorated with bands 140 and bridges 170. The forearm 310 extends from the elbow 320 to the wrist 330. The bracelet 110 includes the bands 120 and 130 worn on the forearm 310 between the wrist 330 and the elbow 320. The bracelet 110 can similarly or additionally be worn on the left arm.

The left image depicts the palm 340 of the right hand with the second brace 190 visible. The right image depicts the back 350 of the right hand with the first brace 180 visible. The handle 240 has a length parallel to the longitudinal direction along the forearm 310. The handle 280 has a length parallel to the transverse direction around the forearm 310.

The left hand (not shown) can retrieve the elbow drawn dagger 220 from the first brace 180 by reaching around the body and grabbing the handle 240 (resembling one of the shapes 160) from the scabbard 230 and pulling upward (towards the shoulder), with the blade 245 extending from the heel of the left hand. Alternatively with both palms facing each other, the left hand can retrieve the wrist drawn pike 260 from the second brace 190 by grabbing the handle 280 from the scabbard 270 by pulling away from the wrist 330, with the blade 285 extending from between the middle and ring fingers near the knuckles. In this manner, depending on posture and hand position, either blade can be retrieved for surprise self-defense. The pikes 260 on both left and right forearms 310 near the wrists 330 can be retrieved concurrently by their opposite hands.

Figure 4:
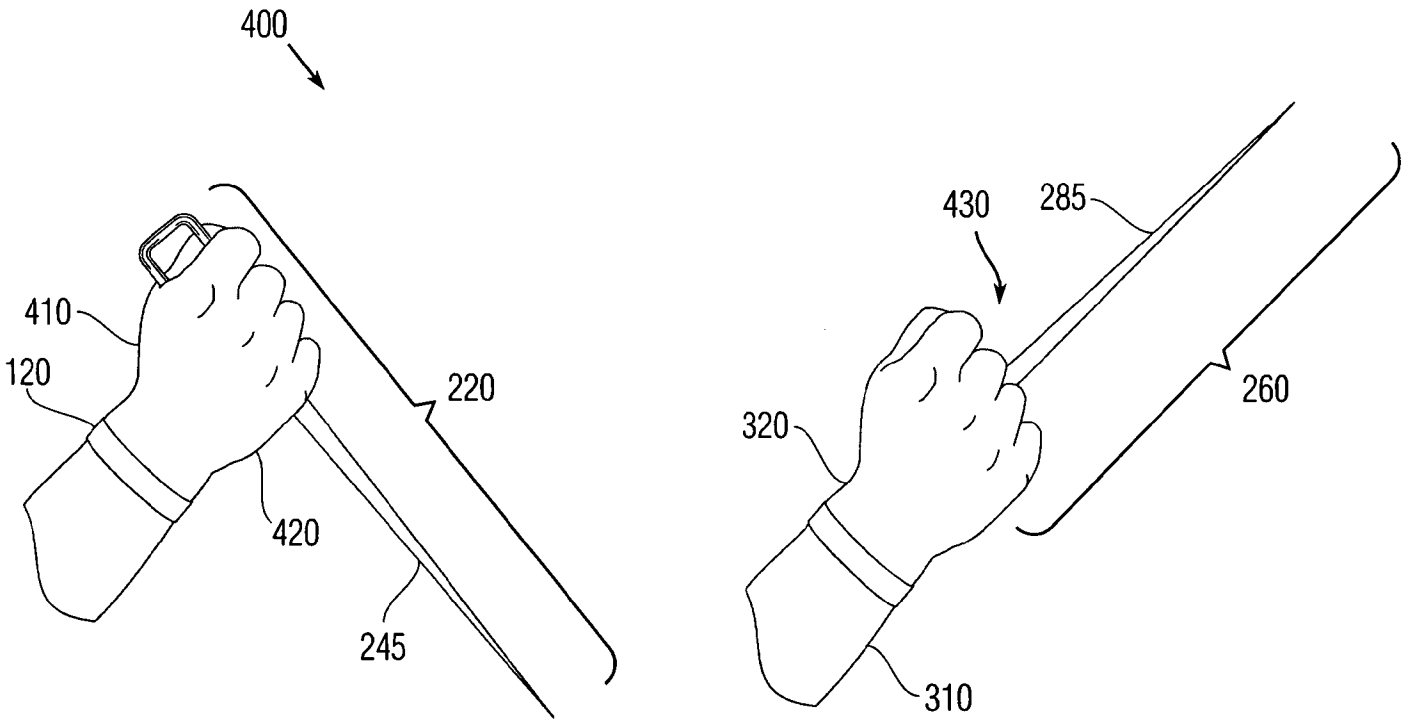
FIG. 4 is a perspective view of fists holding the unsheathed daggers.

FIG. 4 shows perspective views 400 of the right first 410 holding the knives from the bracelet 110 on the left arm (not shown). The left side shows the first 410 holding the elbow drawn dagger 220 by the handle 240 with the blade 245 extending from the clenched heel 420. The right side shows the first 410 holding by the handle 280 the wrist drawn dirk 260 with the blade 285 extending at the hilt 265 from the joint 430 between the middle and ring fingers. Either blade 245 or 285 can be used for stabbing or slashing, although the straight form for rapid retrieval suggests the former would be more effective for such a design.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An arm bracelet for containing a retrievable blade around a forearm between wrist and elbow, said bracelet comprising:

first and second bands for wrapping around and attaching to the forearm, said first band being disposed adjacent the wrist, and said second band being disposed adjacent the elbow;

a plurality of bridges that detachably extend between said first and second band, each bridge displaying a first pattern of uniform shapes with alternating orientations, each shape able to form a grip;

a knife with a handle and the blade, said handle shaped to match the shapes of the first pattern; and a housing for containing a sheath that contains said knife upon insertion therein, said housing displaying a second pattern of uniform shapes with alternating orientations, each shape of the second pattern matching the shapes of the first pattern to disguise said knife and each shape of the second pattern capable of forming a grip.

2. The bracelet according to claim 1, further including a network that connects said first and second bands together along the forearm.

3. The bracelet according to claim 2, wherein said network comprises a plurality of cords that diagonally extend between said bands.

4. The bracelet according to claim 3, wherein said cords are detachable.

5. The bracelet according to claim 1, wherein said shapes are connected by links.

6. The bracelet according to claim 1, wherein said shapes have a rounded rectangle form.

7. The bracelet according to claim 1, wherein said knife has said handle adjacent said second band and the blade points towards said first band.

8. The bracelet according to claim 7, wherein said handle has a length along a longitudinal direction of the forearm.

9. The bracelet according to claim 1, wherein said knife has said handle adjacent said first band and the blade points towards said second band.

10. The bracelet according to claim 9, wherein said handle has a length along a transverse direction around the forearm.

11. The bracelet according to claim 9, wherein the blade includes an unsharpened hilt to enable grabbing said handle between fingers.

12. The bracelet according to claim 1, wherein said sheath and the blade are composed of one of carbon fiber and rigid plastic.

13. The bracelet according to claim 12, wherein said handle and said shapes are composed of one of carbon fiber and rigid plastic.

14. The bracelet according to claim 1, wherein said housing includes first and second housings, said first housing contains a first sheath that holds the knife with the handle adjacent said second band and the blade pointing to said first band, and said second housing contains a second sheath that holds a second knife with a second handle adjacent said first band and a second blade that points to said second band.

15. The bracelet according to claim 1, wherein said sheath and the blade are composed of carbon fiber.

16. The bracelet according to claim 12, wherein said handle and said shapes are composed of carbon fiber.

17. An arm bracelet for containing a retrievable blade around a forearm between wrist and elbow, said bracelet comprising:

first and second bands for wrapping around and attaching to the forearm, said first band being disposed adjacent the wrist, and said second band being disposed adjacent the elbow;

a network of cords that diagonally extend between said bands that connects said first and second bands together along the forearm;

a plurality of bridges that detachably extend between said first and second band, each bridge displaying a first pattern of shapes, each shape able to form a grip and having a uniform profile with alternating orientations;

a knife with a handle and the blade, said handle shaped to match the shapes of the first pattern; and a housing for containing a sheath that contains said knife upon insertion therein, said housing displaying a second pattern of uniform shapes with alternating orientations, each shape of the second pattern matching the shapes of the first pattern to disguise said knife and each shape of the second pattern capable of forming a grip.

18. The bracelet according to claim 17, wherein said handle, said shapes, said sheath and the blade are composed of carbon fiber.

* * * * *